US010490171B1

(12) United States Patent
Horban et al.

(10) Patent No.: US 10,490,171 B1
(45) Date of Patent: Nov. 26, 2019

(54) COMPACT ELECTRONIC GUITAR

(71) Applicant: JAMMY INSTRUMENTS LTD., Nicosia (CY)

(72) Inventors: Mykhailo Horban, Kharkov (UA); Dmytro Doroshenko, Kyiv (UA); Serhii Nastiuk, Kyiv (UA); Oleh Domanskyi, Kyiv (UA); Dmytro Shemet, Kyiv (UA); Volodymyr Shelest, Kyiv (UA)

(73) Assignee: JAMMY INSTRUMENTS LTD., Nicosia (CY)

( * ) Notice: Subject to any disclaimer, the term of this patent is extended or adjusted under 35 U.S.C. 154(b) by 0 days.

(21) Appl. No.: 16/407,536

(22) Filed: May 9, 2019

(30) Foreign Application Priority Data

Feb. 13, 2019 (UA) ..... a201901434

(51) Int. Cl.
*G10H 3/00* (2006.01)
*G10D 1/08* (2006.01)
(Continued)

(52) U.S. Cl.
CPC ..... *G10D 1/085* (2013.01); *G10D 3/06* (2013.01); *G10D 3/10* (2013.01); *G10H 1/342* (2013.01);
(Continued)

(58) Field of Classification Search
CPC ..... G10D 1/085; G10D 3/12; G10D 3/00; G10D 1/00; G10H 1/32; G10H 2220/461; G10H 3/00; G10K 2210/3229
See application file for complete search history.

(56) References Cited

U.S. PATENT DOCUMENTS 3,780,202 A * 12/1973 Law ..... G10H 3/183 84/726
4,295,403 A * 10/1981 Harris ..... G10D 3/06 84/269

(Continued)

*Primary Examiner* — Marlon T Fletcher
(74) *Attorney, Agent, or Firm* — Saliwanchik, Lloyd & Eisenschenk

(57) ABSTRACT

The invention relates to the field of plucked string musical instruments, specifically to designs of electric musical instruments which transform mechanical vibration of strings into electrical signals, more particularly to compact electronic guitars, and can be used in portable electronic guitars.

The application of the invention claimed allows to create a compact electronic guitar that can be quickly assembled/disassembled, while the string elasticity level remains the same in both disassembled and assembled states (making the guitar immediately available for use once the parts of the body have been connected) and to provide the possibility to obtain information about vibrations and excursions of the strings located on the neck occurring as a result of using various playing techniques requiring certain actions to be taken in relation to the strings located on the neck, such as hitting, displacing the pressed string sideward, sudden pressing down of the string and sudden releasing of the pressed string, moving the finger along the string, either pressed or not. This provides the possibility to use a larger number of events occurring with the string to generate acoustic oscillations.

8 Claims, 7 Drawing Sheets

(51) Int. Cl.

| | |
|---|---|
| ***G10H 1/34*** | (2006.01) |
| ***G10D 3/10*** | (2006.01) |
| ***G10D 3/06*** | (2006.01) |
| ***G10H 3/18*** | (2006.01) |

(52) U.S. Cl.
CPC ..... *G10H 3/181* (2013.01); *G10H 2220/461* (2013.01)

(56) References Cited

U.S. PATENT DOCUMENTS

| | | | | |
|---|---|---|---|---|
| 5,949,005 | A | 9/1999 | Peterson | |
| 6,046,393 | A * | 4/2000 | Rose | G10D 1/085 84/267 |
| 6,198,030 | B1 * | 3/2001 | Rose | G10H 1/44 84/290 |
| 6,956,157 | B2 | 10/2005 | Strobel | |
| 7,285,708 | B1 * | 10/2007 | Beckmeier | G10D 3/06 84/314 R |
| 7,579,535 | B2 | 8/2009 | Pyper-Scott | |
| 8,273,974 | B1 | 9/2012 | Gonzalez | |
| 8,878,042 | B2 | 11/2014 | Van Wagoner et al. | |
| 9,082,374 | B2 | 7/2015 | Aires | |
| 9,653,046 | B1 | 5/2017 | Tang | |
| 9,908,043 | B2 * | 3/2018 | Fulghum | A63F 13/245 |
| 2006/0101980 | A1 * | 5/2006 | Jones | G10D 3/06 84/314 N |
| 2006/0123971 | A1 * | 6/2006 | Moghaddam | G10D 1/085 84/290 |
| 2008/0105101 | A1 * | 5/2008 | Eldring | G10D 1/085 84/291 |
| 2008/0202310 | A1 * | 8/2008 | Coke | G10D 1/085 84/291 |
| 2009/0071318 | A1 * | 3/2009 | Miniaev | G10H 1/32 84/731 |

* cited by examiner

COMPACT ELECTRONIC GUITAR

CROSS-REFERENCE TO RELATED APPLICATION

This application claims the benefit of Ukrainian Application No. a201901434, filed Feb. 13, 2019; which is hereby incorporated in its entirety.

FIELD OF THE INVENTION

The invention relates to the field of plucked string musical instruments, specifically to designs of electric musical instruments which transform mechanical vibration of strings into electrical signals, more particularly to compact electronic guitars, and can be used in portable electronic guitars.

BACKGROUND OF THE INVENTION

The lifestyle of a professional guitarist involves regular travelling, touring or relocating. However, the instrument is often too large and too heavy to be conveniently transported.

Today, certain companies, such as Ministar (with its Ministar Travel Guitars), specialize in the production of so-called portable electronic guitars. The developers of Ministar Travel Guitars came to the conclusion that electronic guitars do not need a body (in the traditional sense) as it is merely a tradition that does not contribute to functionality. Therefore, their products have lost this element of design.

Although this approach has solved the problem with overall dimensions, the problem of compact design and portability has remained, especially when it comes to transportation of electronic guitars. Today, numerous patents for inventions of collapsible or detachable necks are known in the art and generally achieve this object in both acoustic and electronic guitars by removing and bending strings.

The prior art known to the inventor discloses a significant number of technical solutions related to compact guitars and electronic guitars, including: U.S. Pat. No. 9,082,374B2 of Jul. 14, 2015, U.S. Pat. No. 7,579,535B2 of Aug. 25, 2009, U.S. Pat. No. 8,273,974B1 of Sep. 25, 2012, U.S. Pat. No. 5,949,005 of Sep. 7, 1999, U.S. Pat. No. 6,956,157 of Oct. 18, 2005, U.S. Pat. No. 9,653,046B1 of May 16, 2017, U.S. Pat. No. 8,878,042B2 of Nov. 4, 2014 and others.

The closest analogue is the technical decision according to U.S. Pat. No. 9,908,043B2 of Mar. 6, 2018, specifically a guitar-shaped video game controller including a body having a shape that resembles a guitar body and a neck pivotally coupled to the guitar body via a hinge so that the neck can pivot between an extended position and a folded position relative to the guitar body, and comprising a retainer latch mechanism and an electric cable. The retainer latch mechanism comprises a latch connector configured to slide into a deployed position that locks the neck in an extended position to the body. The cable extends between the neck and the body and electrically connects the neck to the body irrespective of whether the neck is in the folded position or the extended position relative to the body.

The primary shortcoming of known decision is primarily the complex design of the mechanism connecting the two parts of the body, which makes it impossible to use the guitar immediately following connection of the body parts to obtain information about vibration and excursion of the strings located on the neck as a result of using various playing techniques and to maintain the level of string elasticity both when the guitar is assembled and disassembled.

SUMMARY OF THE INVENTION

Embodiments of the invention result in a compact electronic guitar that can be quickly assembled and disassembled, while the string elasticity level is maintained in both disassembled and assembled states (to make the guitar immediately available for use following connection of the body parts) and to provide the possibility to obtain information about vibrations and excursions of the strings located on the neck occurring as a result of various playing techniques requiring certain actions to be taken in relation to the strings located on the neck, such as hitting, displacing the pressed string sideward, suddenly pressing down a guitar string and sudden releasing it, and moving the finger along the string, either pressed or not. This provides a possibility to use a larger number of events occurring with the string to generate acoustic oscillations.

An exemplary embodiment of a compact electronic guitar comprises a body assembled of two parts connected to each other; strings tightened over the body; string vibration sensors attached to the body; an electrical connector positioned on one part of the body; according to the invention, the two parts of the body are configured so that they can be mechanically and electrically connected to each other, with a set of strings and vibration sensors installed on each part of the body; the mechanical connection is configured to form a rod located in one part of the body and the corresponding socket made in the second part of the body; said rod is made tubular with a geometric axis parallel to the geometric axis of the body and shifted relative to the latter; the rod is fastened in the socket by two ball plungers and a retainer with a roller attached thereto; said plungers and retainer are positioned in the socket and engage respectively with the plunger groove and the retainer slot located on the rod; the electrical connection is configured to form contact pairs comprising contact pads located on the end of the rod and contact springs located inside the rod installation socket.

Further, an elastic gasket can be placed on the end side of one part of the body, and a groove can be made on the end side of the other part of the body for coupling with the elastic gasket.

Further, the rod has a round-cornered trapezoid cross-section.

Further, the rod can be configured to taper towards the retainer slot with a taper ratio within C=1:50÷1:80.

Further, the rod can be made of metal and/or plastic.

Further, the plungers can be made spring-loaded.

Further, string vibration sensors can be made optical.

Further, one part of the body can be equipped with sensors determining the point where the string is pressed to the body.

There is a causal relationship between the set of essential features of the invention and the technical result achieved with the use of the invention is as follows.

There are known guitars that can be disassembled and assembled for compact transportation. However, said guitars cannot be configured to be quickly disassembled and assembled and, at the same time, to maintain the same string elasticity level both in the disassembled and assembled states, and to be immediately available for use once the parts of the body have been connected. The inventor has carried out a significant number of experiments to improve the connection of electronic the electronic guitar parts to ensure the required string elasticity level in any state of the electronic guitar. The testing process has shown that when the electronic guitar is configured to have two parts that are mechanically and electrically connected to each other, and there is a set of strings and string vibration sensors installed on each part of the body, this approach provides for a reliable compact design and ease of use, while also, to some extent, making the body parts independent of each other when the guitar is disassembled which, consequently, allows to maintain the string elasticity level.

The configuration in which an individual set of strings is placed on each part of the body primarily solves the problem of convenience of assembling and disassembling the electronic guitar, e.g. one does not need to remove strings for the purposes of transportation and then, while assembling the electronic guitar for playing, does not need to tighten and fasten the strings again, making it easier to use the electronic guitar. This allows one to maintain the required string elasticity level and technical characteristics and makes it unnecessary to tighten or adjust strings each time the guitar is assembled. In addition, dividing the strings into separate sets helps to simplify the processing of events occurring on the string, i.e. to develop more efficient and simpler event processing algorithms.

The configuration with a set of string vibration sensors on each part of the body primarily provides the possibility to perform various guitar playing techniques (such as plucking and hitting the strings) both in the part of the electronic guitar where the sounding board is traditionally placed (the right side) and in the part where the neck is traditionally placed (the long left part). In other words, this allows a guitarist to play by pressing strings on the part of the electronic guitar where the neck is traditionally placed, that is, not only to convey information about the frets, but also to affect the strings causing them to vibrate, i.e. to hit the strings on the both parts. The string vibration sensors are made optical to record string vibrations and movements in response to plucking and hitting the strings (with fingers or a mediator) or muting the string, so that such sensors provide information on how the string changes its position in space relative to its zero position.

Further, the optical sensor can be made as an optical sensor comprising a base, at least one optical emitter and at least one optical receiver located on said base so that a light beam of at least one optical emitter forms a light spot that completely covers the photosensitive surface of at least one optical receiver, with at least one optical emitter and at least one optical receiver being located under the same string; the optical emitter generates light beams, and the optical receiver comprises at least two photosensitive surfaces to form, together with the optical emitter, at least two optical pairs (the lower one and the upper one), and a light beam modulator is located between the optical pairs to cover a part of each of said photosensitive surfaces, equipped with a means of fixing to the string and configured to change the area of the illuminated part of the upper photosensitive surface and the area of the illuminated part of the lower photosensitive surface when a string, with the modulator attached thereto, deflects in horizontal and vertical planes, respectively.

According to one aspect of the invention, one part of the body contains sensors determining the point where the string is pressed to the body, in particular, it is the part where the neck is traditionally placed. Such sensors help to provide information on the position of fingers pressing the string so that a greater variety of events occurring on the string can be recorded.

While playing an electronic guitar, the user (guitarist) can perform many actions on the part of the guitar where the neck is traditionally placed, including pressing the string, moving the finger along the pressed string (sliding), touching the string without pressing, pressing the string suddenly (that can be, and is, called "hitting the string with the finger"), releasing the string suddenly, or displacing the pressed string sideward (bending). Some of these events generate an event that is necessary only for the note that is already sounding and for the production of sound on the part where the sounding board is traditionally placed (by pressing, touching, releasing, or bending), or these events can themselves generate an event that produces a sound (a sudden hit on the string itself should cause a sound, with no involvement of the right hand). For such a variety of events, it is necessary to use all the available information, which is achieved by string vibration sensors (made optical), the sensors determining the point where the string is pressed to the body; capacitive sensors, which help to get information on the finger touching the string, can also be used.

Therefore, the configuration with two individual sets of sensors for the two parts of the body allows to improve the analysis and processing of each individual event generated by the user's hands on each part of the body.

The testing process of the electronic guitar has showed that the mechanical division into two parts allows the inventor to realize the concept of a portable guitar wherein each of the two separated parts has overall dimensions smaller than those of a single-piece instrument, which is important in terms of convenient transportation during travelling or transporting in luggage, in a bag or a backpack, etc. Further, as noted above, dividing the body into two parts allows for independent processing of the effect produced on each string, which simplifies the event detecting algorithms.

However, it is ideal to provide a quick assembling and disassembling procedure for the device by means of maximum reduction of the number of steps to be taken by the user and additional tools or instruments (to connect, screw in/out the parts, etc.). The solution should also take into account the specific operating conditions, in particular high dynamic loads on connectors during the actual playing (users may have a very active playing technique and pull the parts in the longitudinal and transverse directions, bend the device, etc.).

Further, the chosen solution should provide a reliable electrical connection in the assembled state so that the two parts can exchange electrical signals, and the electrical contacts used should have sufficient service life for as long as the device is in operation.

With the express aim of providing the desired reliability for the solution, the inventor has developed an electronic guitar that provides both sufficient mechanical connection and sufficient electric connection. According to the aspects of the invention, the mechanical connection is designed as the rod located in one part of the body with the respective socket positioned in the second part of the body to ensure a reliable connection of the two parts of the guitar. Further, the rod is made tubular with the geometric axis parallel to the geometric axis of the body and shifted relative thereto to ensure that the parts cannot be assembled incorrectly.

The ultimate fastening of the rod in the socket is achieved by exemplified means of two ball plungers and the retainer with the roller attached thereto, both placed in the socket, which engage respectively with the plunger installation grooves and the retainer installation slot made on said rod. The configuration of ball plungers allows for automatic fastening of the rod when it is placed in the socket with a certain effort. Further, according to one aspect of the invention, the plungers are spring-loaded. The spring-loaded plungers give the user the tactile feedback as the user can hear a clicking sound at the appropriate moment so that the connection of the parts becomes more predictable. Said roller is designed with a shifted axis (below the rotation axis of the retainer). This, along with the shape of the retainer installation slot on the rod, ensures that the rod fits tightly when the user applies sufficient force to close the retainer by pressing it with his/her finger. The use of the roller reduces friction at the moment of opening/closing, which allows the retainer to be closed and opened with perceived ease of use.

According to another embodiment of the invention, the rod has a round-cornered trapezoid cross-section. Such configuration of the rod allows for tighter and smoother positioning in the socket.

According to yet another embodiment of the invention, the rod is made of metal, for example, of aluminum alloy, and/or of plastic, in particular of durable plastic, to ensure the strength of connecting elements while in constant use.

According to embodiments of the invention, the electrical connection is designed/configured as contact pairs comprising contact pads placed on the end side of the rod and contact springs placed inside the rod installation socket. Such configuration of the connection provides a reliable electrical connection of signal lines and power lines. To inhibit short circuit or damage during transportation or during connection, the contact springs are placed inside the socket, while the flat contact pads are placed on the end of the rod. When the rod is inserted into the socket, the working parts of the contact springs come into contact with the surface of the contact pads. Since the design of the connecting part inhibits substantial displacement in the longitudinal axis of the parts relative to each other, this provides a long service life of the contacts because there is no transverse displacement of the contact surfaces and friction at the time of connection, disconnection and while in use. Further, the controllers of both of the parts may provide for the implementation of the connection detection protocol based on a low-precision signaling circuit, and provide power and other critical signals only when reliable connection is achieved over the period of time that exceeds the protection interval (for protection against "fluctuation" of the contacts).

Such a solution provides easy-to-use, reliable and fast connection and disconnection of the parts, on the one hand, and reliable electrical connection in the connected position, on the other.

According to yet another embodiment of the invention, the rod is configured to taper towards the retainer installation slot with a taper ratio within C=1:50÷1:80. Based on the dimensions and the shape of the electronic guitar, such a configuration of the rod with said taper ratio increases the reliability of fastening of the rod in the socket, while said taper ratio is sufficient to include the required number of contact pairs.

According to still other embodiments of the invention, an elastic gasket is placed on the end side of one part of the body, and a groove is made on the end side of the second part of the body for coupling with the elastic gasket. The elastic gasket can be made of silicone rubber (or a different type of rubber). The elastic gasket helps minimize any possible gaps between the connected parts and inhibit any possible squeaking of the surfaces of the electronic guitar.

BRIEF DESCRIPTION OF THE DRAWING

The invention disclosed herein will be more clearly understood from the following exemplary embodiment in with accompanying drawings in which.

Figure 1:
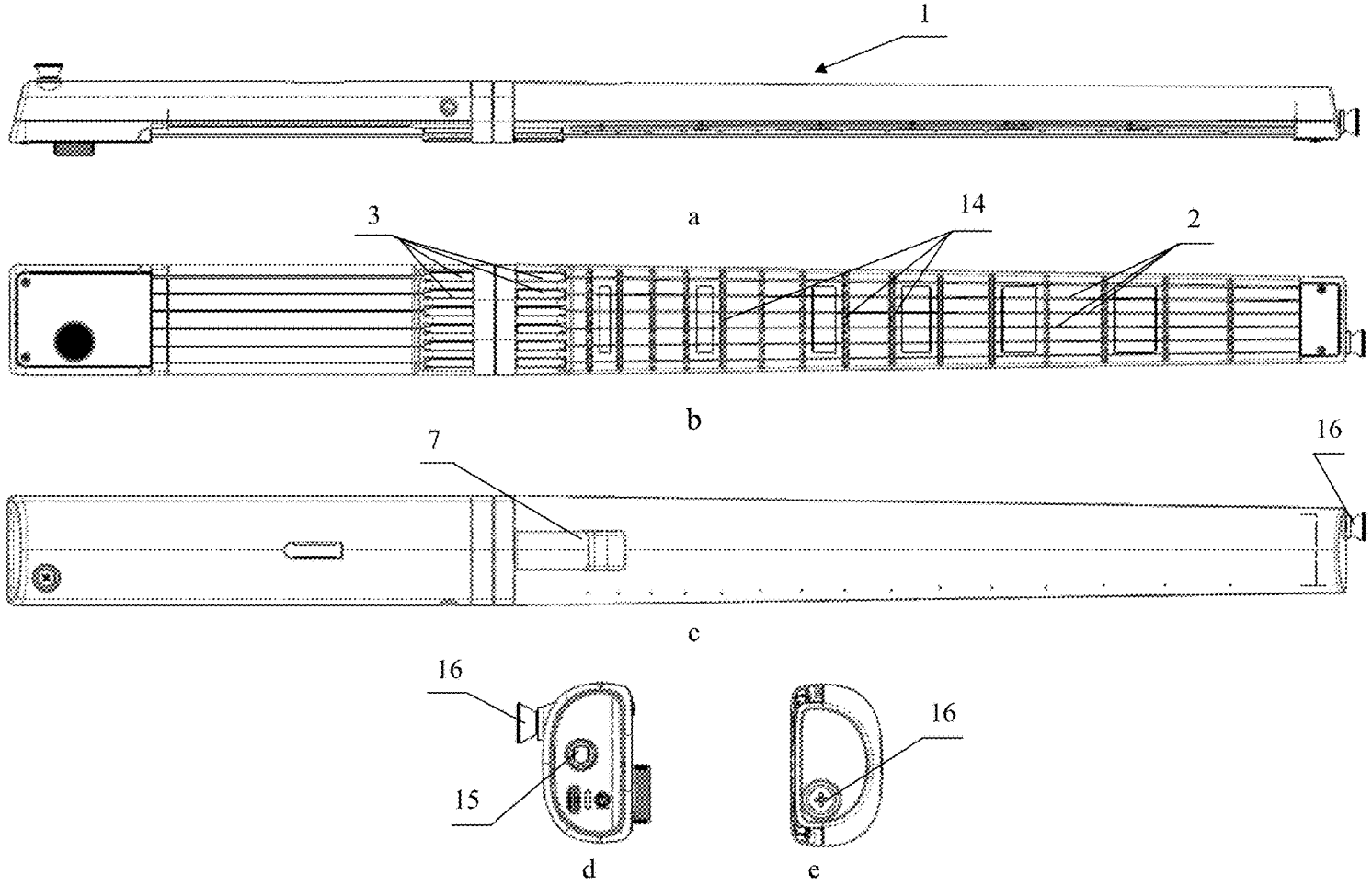
FIG. 1 is a view of the compact electronic guitar in the folded state: a—side view, b—top view, c—bottom view, d—right view, e—left view.
Figure 2:
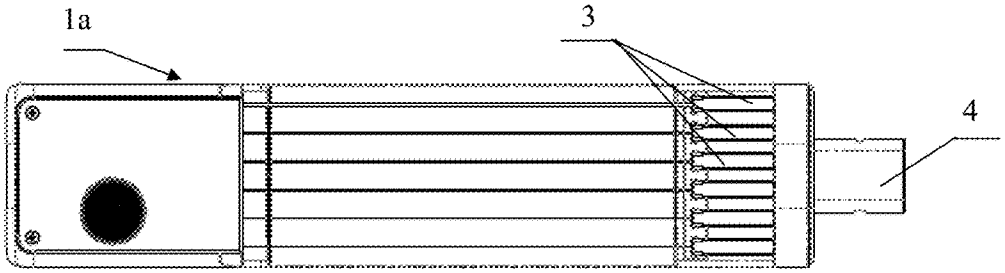
FIG. 2 is a view of one part of the body of the compact electronic guitar (hereinafter, position 1*a*).
Figure 3:
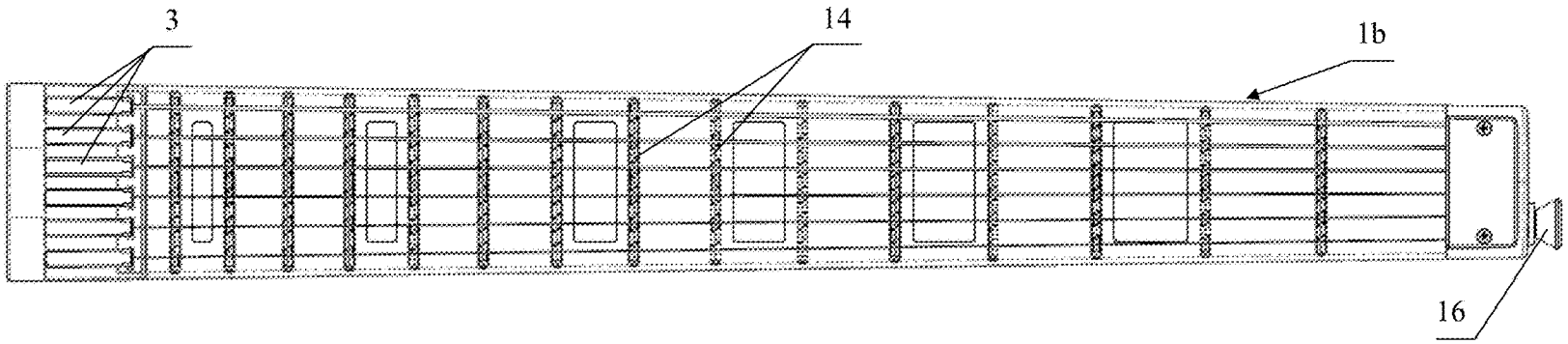
FIG. 3 is a view of the second part of the body of the compact electronic guitar (hereinafter, position 1*b*).
Figure 4:
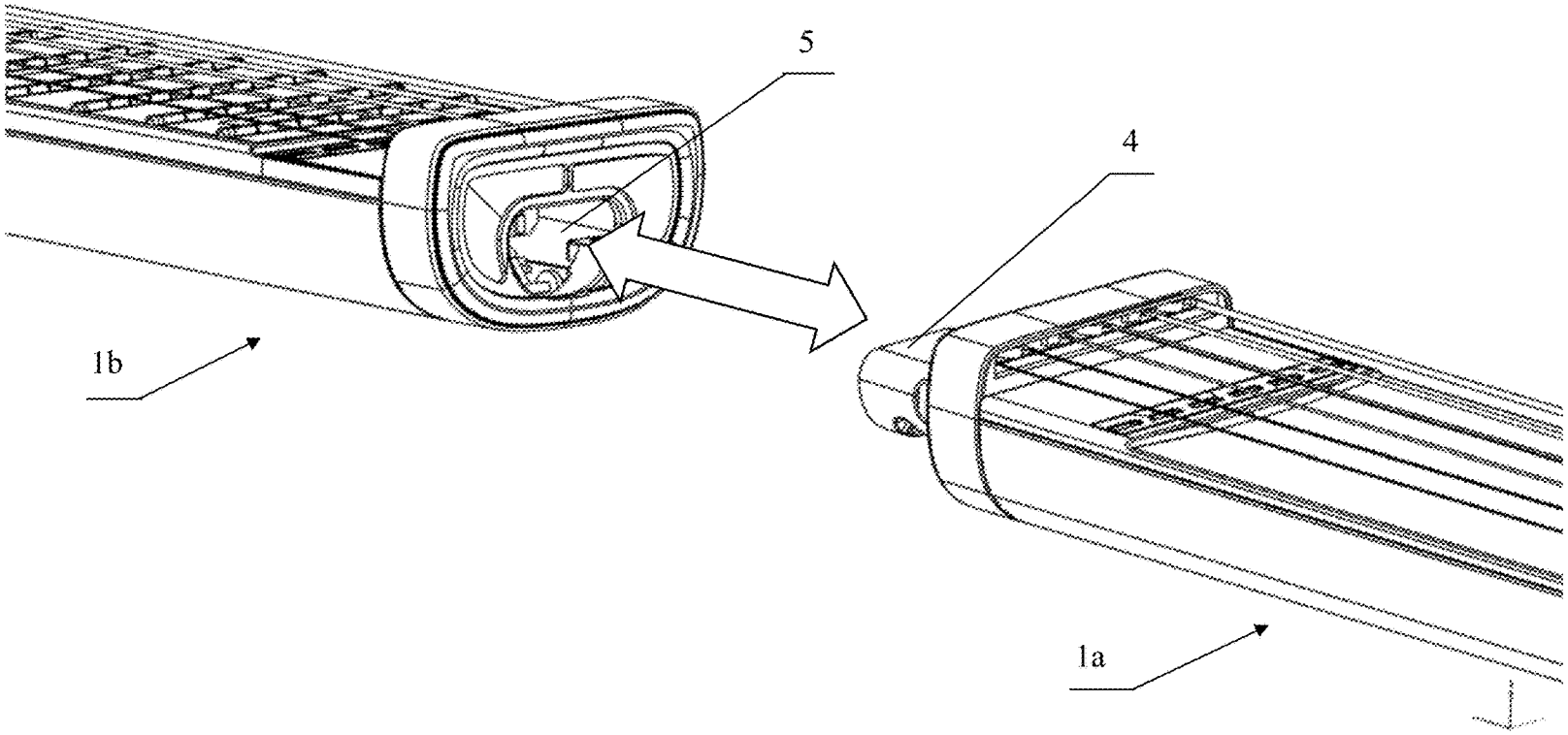
FIG. 4 is a fragment of the connection of the compact electronic guitar in the extended state—two parts of the body (hereinafter, 1*a* and 1*b*).
Figure 5:
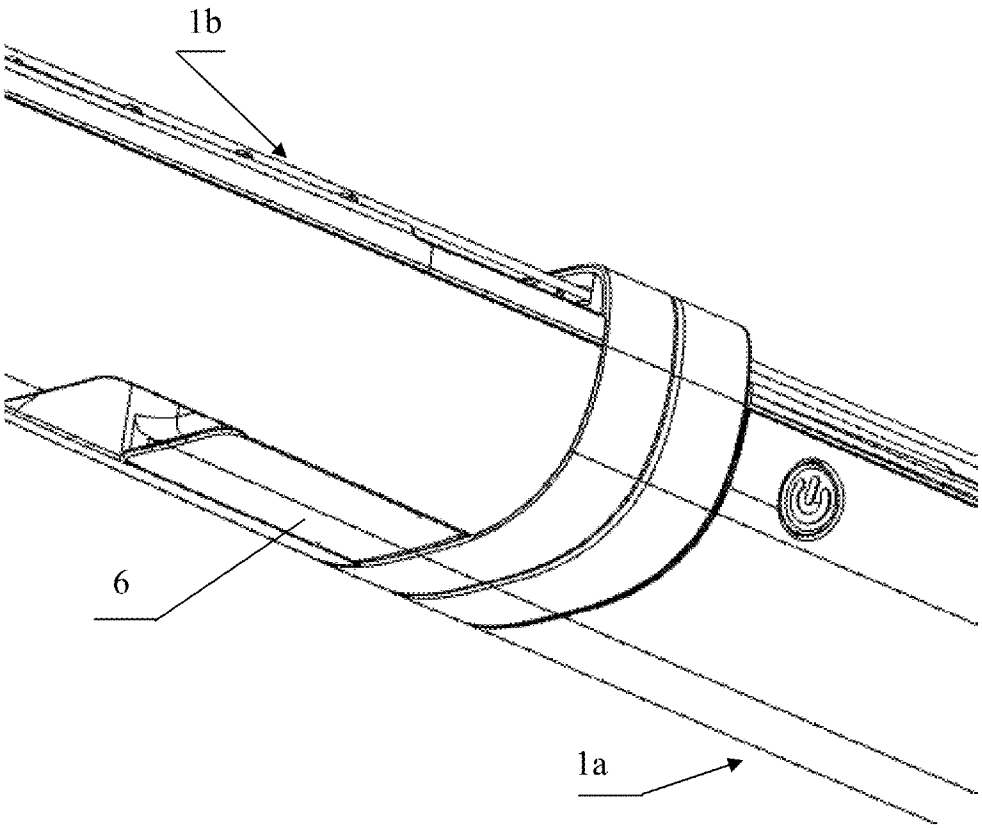
FIG. 5 is a fragment of the connection of the compact electronic guitar in the folded state—two parts of the body (hereinafter, 1*a* and 1*b*).
Figure 6:
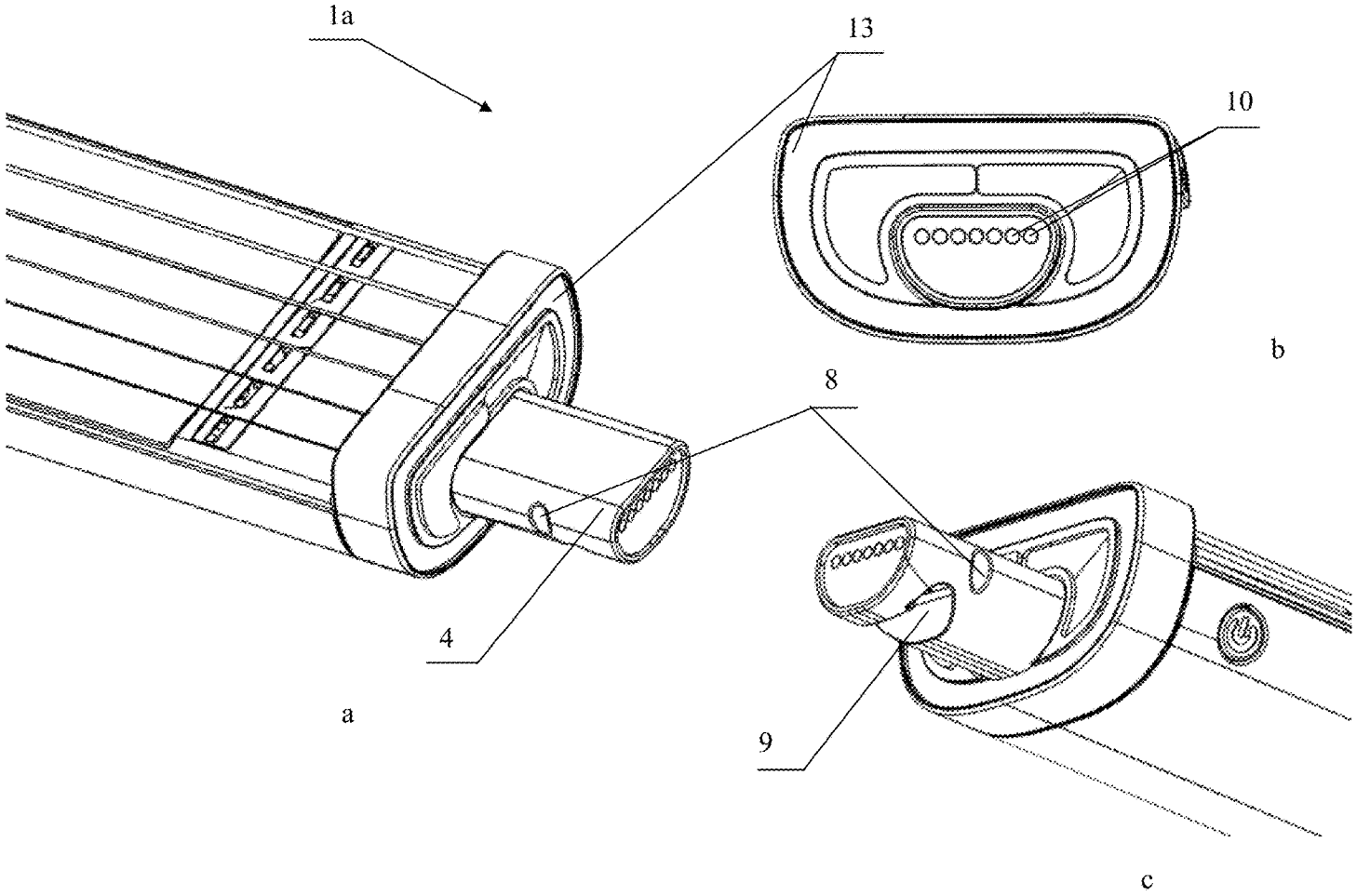
FIG. 6 is a fragment of part 1*a* of the body: a—top-down view, b—end side view, c—bottom-up view.
Figure 7:
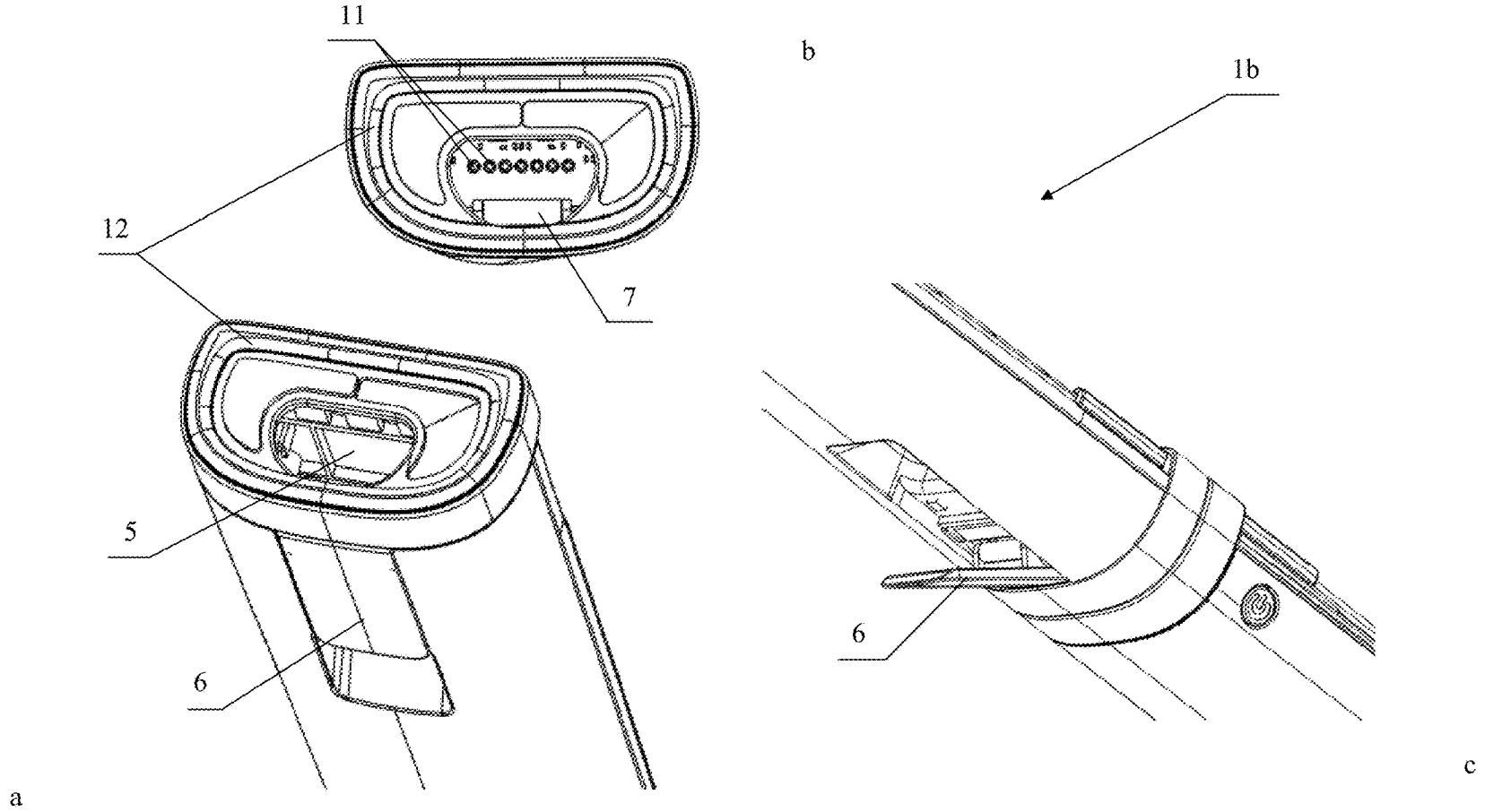
FIG. 7 is a fragment of part 1*b* of the body: a—bottom-up view, with the closed retainer, b—end side view, c—bottom-up view, with an open retainer.
Figure 8:
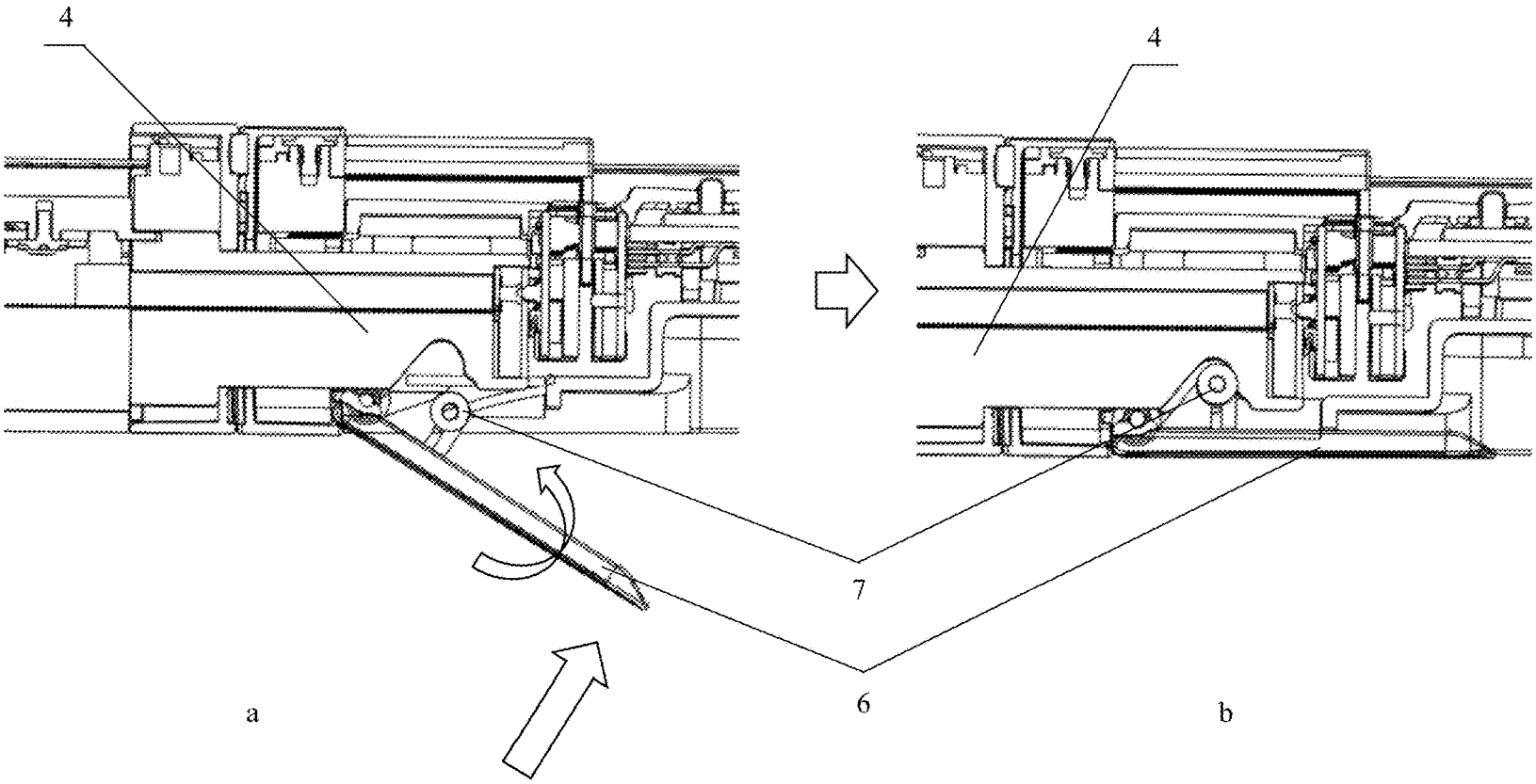
FIG. 8 is a cross-sectional view of a fragment of part 1*b* of the body: a—cross-sectional view of the part 1*b* fragment with an open retainer; b—cross-sectional view of the part 1*b* fragment with a closed retainer.

Figure drawings that illustrate the invention claimed as well as particular embodiments are merely exemplary in nature and are in no way intended to limit the claims appended hereto but to explain the essence of the invention.

DETAILED DESCRIPTION OF THE INVENTION (INFORMATION CONFIRMING THE POSSIBILITY OF EMBODIMENT)

An exemplary compact electronic guitar comprises a body 1, strings 2, and string vibration sensors 3 attached to the body 1. The body 1 comprises two parts connected to each other. The strings 2 are two individual sets of strings placed on each part of the electronic guitar. Similarly, the string vibration sensors 3 are two individual sets, each placed on each part of the electronic guitar.

The two parts of the body 1 (1*a* and 1*b*) are connected to each other mechanically and electrically. Part 1*a* is the part of the electronic guitar where the sounding board is traditionally placed, while part 1*b* is that part where the neck is traditionally placed.

The mechanical connection is designed as a rod 4 located in part 1*a* of the body 1 and a corresponding socket 5 in part 1*b* of the body 1. The rod 4 is cone-shaped with its geometric axis parallel to the geometric axis of the body 1 and shifted relative thereto to inhibit misconnection of the parts when the guitar is assembled. The rod 4 can be made of metal, in particular, of aluminum alloy.

The rod 4 can be fastened in the socket 5 by two spring-loaded ball plungers (not shown) and a retainer 6 with a roller 7 attached thereto, which are located in the socket 5. When the two parts of the body 1 are connected, the two ball plungers engage with plunger installation grooves 8 made on the rod 4. Further, when the two parts of the body 1 are connected, the retainer 6 with the roller 7 attached thereto engages with the retainer installation slot 9 made on the rod 4.

The rod 4 in this embodiment is configured to taper towards the retainer installation slot 9 with the taper ratio C=1:70.

The electrical connection can be made in the form of spring-loaded Pogo pins contact pairs comprising gold-plated contact pads 10 placed on the end side of the rod 4 and gold-plated spring contacts 11 placed inside the socket 5. The total number of contact pairs can be 7.

An elastic gasket 12 can be placed on the end side of body part 1*b*, and a groove 13 can be made on the end side of body part 1*a* for coupling with the elastic gasket 12. The elastic gasket 12 can be made of silicone rubber.

The string vibration sensors 3 are optionally made optical and can be placed on each part of the body 1 in connection points of parts 1*a* and 1*b*. Optical sensors can be configured to receive signals corresponding to oscillations (deviations) of the string in two mutually perpendicular planes.

Part 1*b* of the body further can comprise sensors determining the point where the string is pressed to the body 14.

Further, capacitive sensors (not shown) may be installed on the body 1 to receive information on the string 2 being touched with a finger.

An electrical connection 15 is made on the end side of part 1*a*.

Further, part 1*b* of the body may comprise a means for belt mounting 16 on the end side.

The exemplified compact electronic guitar works as follows. The two parts of the body 1 (1*a* and 1*b*) are connected following the one-click scenario, i.e. the parts are connected in one user movement. To make the connection as convenient as possible, it is advisable that the rod 4 should be pre-fastened in the socket 5 after their connecting to each other to allow the user to securely handle the parts as needed. It is for this purpose that two spring ball plungers are placed in the socket 5 to fasten the rod 4 automatically when it is placed in the socket 5 with a certain effort.

When the rod 4 is inserted into the socket 5, the working parts of the spring contacts 11 are pressed against the surface of the contact pads 10 to provide an electrical connection.

To fasten the rod 4 ultimately in the socket 5, the retainer 6 with the roller 7 attached thereto is used to ensure that the rod 4 is tightly fit when the user applies sufficient effort to close the retainer 6 by pressing it with a finger. The rod 4 is held pressed by overcoming the resistance of the plunger springs and the spring contact pairs to the final ("closed") state and held in this position until the moment of forced disconnection by opening the retainer 6 in the opposite direction.

While playing the electronic guitar, the user exerts effort on the strings 2, such as pressing the string 2, moving the finger along the pressed string 2 (sliding), touching the string 2 without pressing, pressing the string 2 suddenly, releasing the string 2 suddenly, or displacing the pressed string 2 sideward (bending). To get sufficient information from such a variety of events, the string vibration sensors 3 and the sensors determining the point where the string is pressed to the body 14 are used; capacitive sensors (not shown), which help to get information on the string being touched with a finger, can also be used.

Thus, the application of the invention claimed allows to create a compact electronic guitar that can be quickly assembled/disassembled, while the string elasticity level remains the same in both disassembled and assembled states (making the guitar immediately available for use once the parts of the body have been connected) and to provide the possibility to obtain information about vibrations and excursions of the strings located on the neck occurring as a result of using various playing techniques requiring certain actions to be taken in relation to the strings located on the neck, such as hitting, displacing the pressed string sideward, sudden pressing down of the string and sudden releasing of the pressed string, moving the finger along the string, either pressed or not. This provides the possibility to use a larger number of events occurring with the string to generate acoustic oscillations.

The invention claimed is:

1. A compact electronic guitar comprising:

a body assembled of two parts connected to each other, strings tightened over the body, string vibration sensors attached to the body, and an electrical connector positioned on one part of the body, wherein the two parts of the body are configured so that they can be mechanically and electrically connected to each other, with a set of strings and vibration sensors correspondingly installed on each part of the body;

the mechanical connection is configured to comprise a rod located in one part of the body and the corresponding socket made in the second part of the body; said rod is made tubular with a geometric axis parallel to the geometric axis of the body and shifted relative thereto; the rod is fastened in the socket by two ball plungers and a retainer with a roller attached thereto; said plungers and retainer are positioned in the socket and engage respective with the plunger installation grooves and with a retainer installation slot located on the rod; and the electrical connection is configured to comprise contact pairs comprising contact pads located on the end of the rod, and contact springs correspondingly located inside the rod installation socket.

2. The compact electronic guitar according to claim 1 wherein an elastic gasket is placed on the end side of one part of the body, and a complementary groove is made on the end side of the second part of the body for coupling with the elastic gasket.

3. The compact electronic guitar according to claim 1 wherein the rod has a round-cornered trapezoid cross-section.

4. The compact electronic guitar according to claim 1 wherein the rod is configured to taper towards the retainer slot with a taper ratio within C=1:50÷1:80.

5. The compact electronic guitar according to claim 1 wherein the rod is made of metal and/or plastic.

6. The compact electronic guitar according to claim 1 wherein the plungers are spring-loaded.

7. The compact electronic guitar according to claim 1 wherein the string vibration sensors are optical sensors.

8. The compact electronic guitar according to claim 1 wherein one part of the body is equipped with sensors determining a point where each string is pressed to the body.

* * * * *